US006000839A

United States Patent [19]

Lott

[11] Patent Number: 6,000,839

[45] Date of Patent: Dec. 14, 1999

[54] CONTINUOUS STATIC MIXING APPARATUS

[75] Inventor: W. Gerald Lott, Houston, Tex.

[73] Assignee: Flo Trend Systems, Inc., Houston, Tex.

[21] Appl. No.: 09/097,080

[22] Filed: Jun. 12, 1998

Related U.S. Application Data

[63] Continuation of application No. 08/831,862, Apr. 2, 1997, Pat. No. 5,765,946

[60] Provisional application No. 60/014,550, Apr. 3, 1996.

[51] Int. Cl.[6] ..... B01F 15/02; B01F 5/06

[52] U.S. Cl. ..... 366/181.5; 366/177.1; 366/336

[58] Field of Search ..... 366/181.5, 177.1, 366/336, 150.1, 160.1, 160.3, 162.4, 163.2, 167.1, 173.1, 174.1, 175.2, 340, 337, 338

[56] References Cited

U.S. PATENT DOCUMENTS

| | | | |
|---|---|---|---|
| 2,669,946 | 2/1954 | Peyton | 366/340 |
| 3,526,391 | 9/1970 | Church, Jr. | 366/340 |
| 3,826,279 | 7/1974 | Verschuur | 366/340 |
| 3,886,973 | 6/1975 | Kinney | 366/340 |
| 3,913,617 | 10/1975 | Van Laar et al. | 366/340 |
| 4,122,031 | 10/1978 | Smith | 366/340 |
| 4,264,212 | 4/1981 | Tookey | 366/340 |
| 4,325,712 | 4/1982 | Arnaudeau | 366/340 |
| 4,382,684 | 5/1983 | Hori | 366/340 |
| 4,519,423 | 5/1985 | Ho et al. | 366/340 |
| 4,568,003 | 2/1986 | Sperry et al. | 366/340 |
| 4,594,005 | 6/1986 | Sakamoto et al. | 366/181.5 |
| 4,647,212 | 3/1987 | Hankinson | 366/340 |
| 4,886,369 | 12/1989 | Hankinson | 366/340 |
| 4,957,242 | 9/1990 | Schadow et al. | 366/340 |
| 4,971,768 | 11/1990 | Ealba et al. | 366/340 |
| 5,046,668 | 9/1991 | Ikeuchi et al. | 366/340 |
| 5,110,560 | 5/1992 | Presz, Jr. et al. | 366/340 |
| 5,165,440 | 11/1992 | Johnston | 366/340 |
| 5,232,283 | 8/1993 | Goebel et al. | 366/340 |
| 5,435,913 | 7/1995 | Ashbrook | 366/340 |
| 5,460,449 | 10/1995 | Kent et al. | 366/340 |

*Primary Examiner*—Tony G. Soohoo
*Attorney, Agent, or Firm*—Keeling Law Firm

[57] ABSTRACT

A continuous static mixing apparatus includes mixing disks. Each of the mixing disks has a set of symmetrically distributed nozzles therein that accelerate the flow and that create a mixing turbulence in the flow. Typically, the mixing apparatus combines the outlet flows of the mixing disks to provide a collision therebetween and, thus, increased turbulence and mixing. Communication passageways connect the material supplies to the mixing apparatus and direct the materials through the mixing disk. The materials may be combined either upstream or downstream of the mixing disks. An eductor may be used to combine the materials upstream of the mixing disks.

19 Claims, 9 Drawing Sheets

CONTINUOUS STATIC MIXING APPARATUS

This application claims the benefit and is a continuation of U.S. Non-Provisional Application No. 08/831,862 filed on Apr. 2, 1997, now U.S. Pat. No. 5,765,946, which itself claims the benefit of U.S. Provisional Application No. 60/014,550 filed on Apr. 3, 1996.

BACKGROUND OF THE INVENTION

1. Field of Invention

This invention relates to a device for mixing. More specifically, it is directed to a static mixing apparatus that provides continuous mixing of a plurality of flowable materials.

To provide large scale continuous mixing of flowable materials (i.e. gases, liquids, and powders), materials are generally combined in a mixing chamber where they are then mixed by mechanical stirring, turbulence or other fluid dynamic means. Often, the purpose of the mixing is to achieve a reaction. Inefficiencies in the mixing may result in waste of reactants and, thus, waste of related resources (e.g. money, time, energy, etc.) as well as other complications. Static mixers, those requiring no moving parts to operate, offer lower costs in manufacture, operation, maintenance, and initial costs of chemicals.

2. Related Art

Continuous static mixers are known to the prior art. Illustrative of such mixers are U.S. Pat. Nos. 3,913,617, 4,264,212, 4,647,212 and 4,886,369.

Though the above mentioned mixers may be helpful for the purposes for which they were designed, they can be improved to provide more efficient and thorough mixing.

SUMMARY OF THE INVENTION

Accordingly, the objectives of this invention are to provide, inter alia, a continuous static mixing apparatus and process that:

provides continuous mixing;

requires no moving parts;

produces improved, thorough mixing of a plurality of flowable materials, including both bulk mixing and molecular dispersion;

utilizes a plurality of nozzles having non-circular outlets;

creates a chaotic turbulent flow to increase the mixing;

combines turbulent flows to enhance the turbulence and mixing;

is easy to implement and use;

is low in cost; and has a relatively compact design to facilitate portability.

Other objects of the invention will become apparent from time to time throughout the specification and claims as hereinafter related.

To achieve such improvements, my invention is a continuous static mixing apparatus for mixing a plurality of flowable materials that includes at least one mixing disk that creates a turbulent mixing flow downstream of the mixing disk. The mixing disk has a plurality of nozzles for accelerating the flow and for creating turbulence therein. Additionally, the mixing disk includes a director means on its upstream side. The mixing apparatus may either (1) direct the combined primary and secondary materials through the at least one mixing disk or (2) combine the primary and secondary materials in the turbulent flow downstream of the mixing disks. In the first embodiment, the mixing apparatus may include an eductor for the initial combination of the materials.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figure 1:
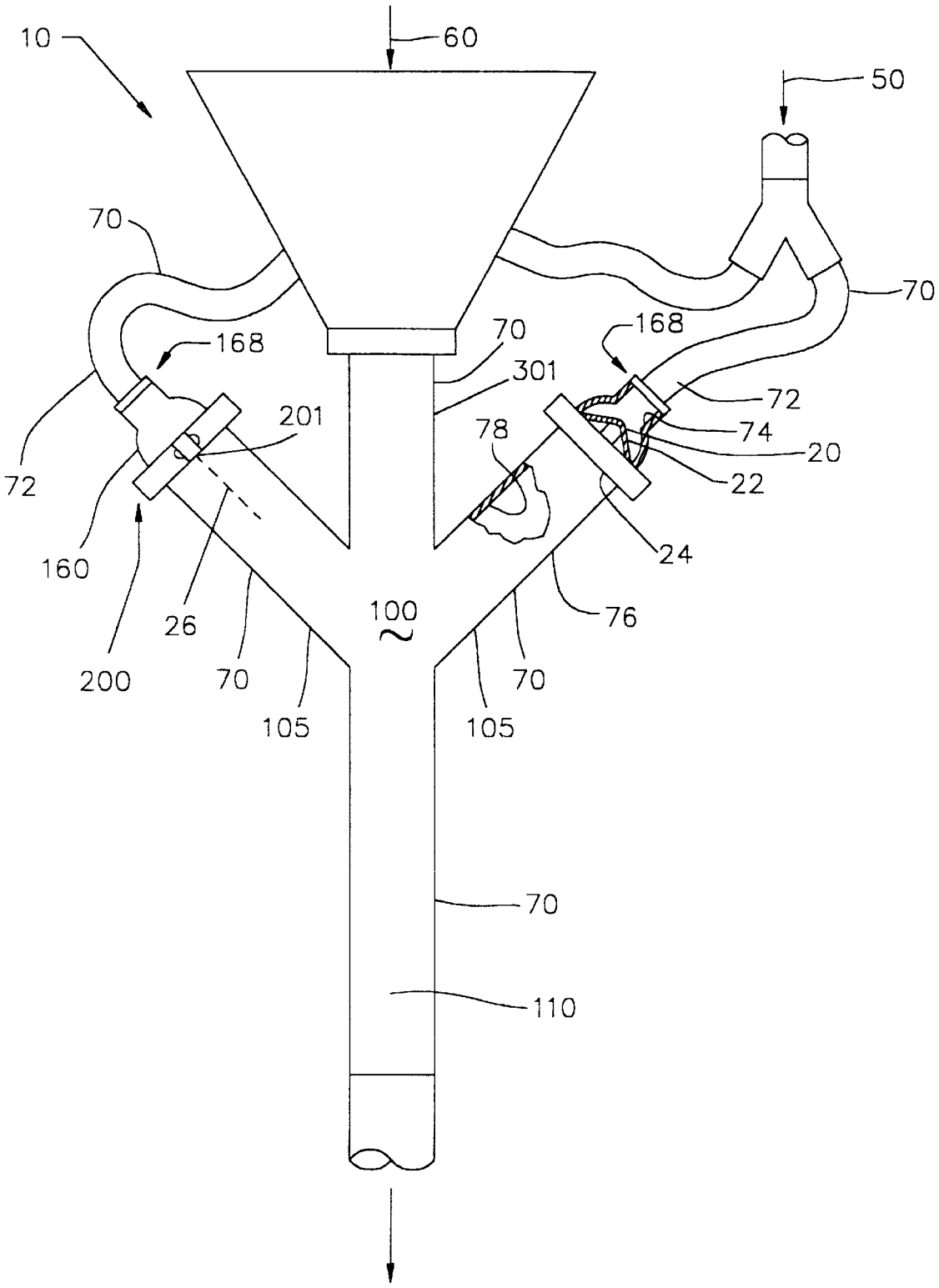
FIG. 1 is a partial cross sectional, side view of one preferred embodiment of the continuous static mixing apparatus wherein the secondary material is added downstream of the mixing disks and the angle of intersection between the flows of each disk is approximately 90 degrees.
Figure 2:
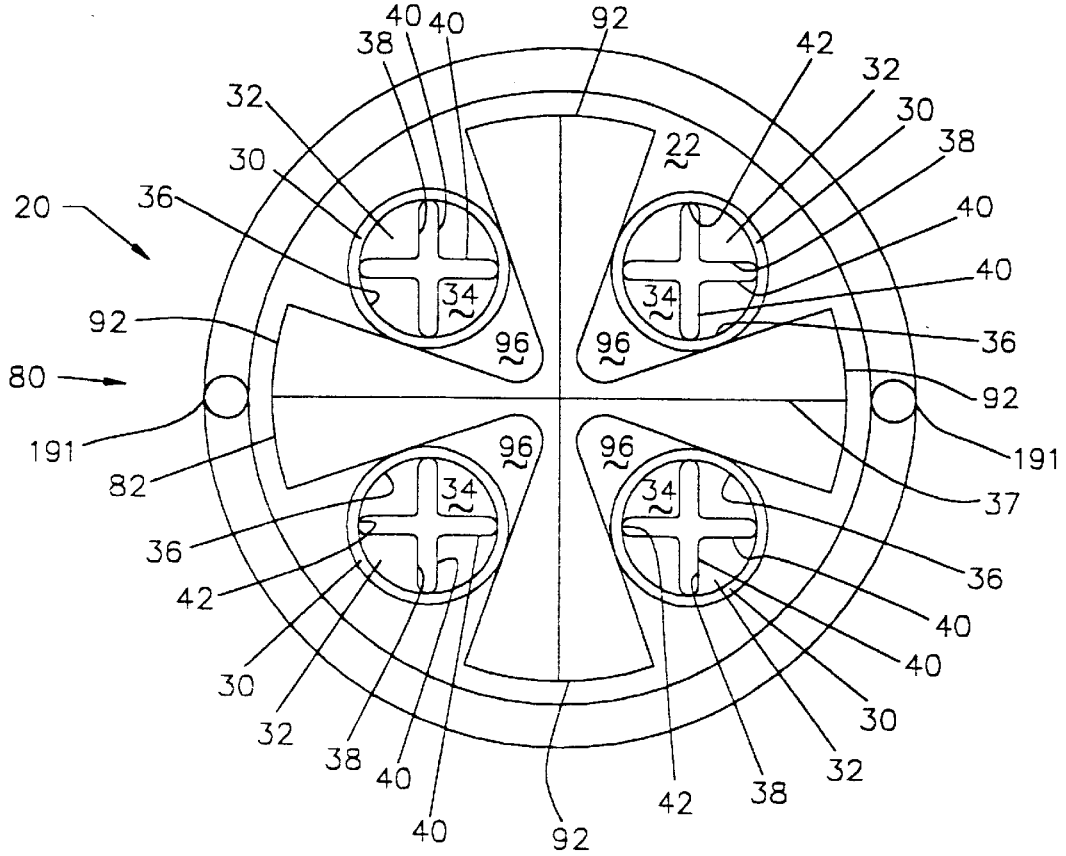
FIG. 2 is an elevational view of the upstream side of a mixing disk.
Figure 3:
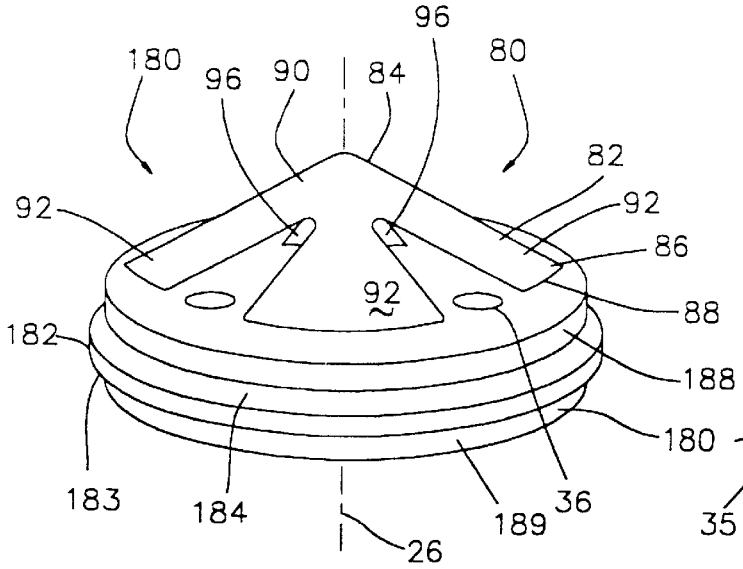
FIG. 3 is an isometric view of a mixing disk.
Figure 4:
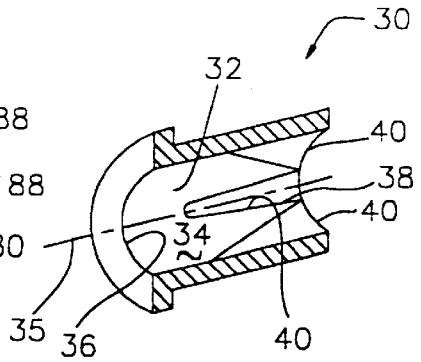
FIG. 4 is a cross-sectional view of a mixing disk nozzle.

The preferred embodiments of my invention are illustrated in FIGS. 1 through 15 and the continuous static mixing apparatus is depicted as 10. In general, mixing apparatus 10 mixes a multiple number of flowable materials.

Although multiple flowable materials may be mixed using the present invention, at least one of the flowable materials must be a fluid. The other materials may be powder materials.

Furthermore, for purposes of brevity and clarity, the specification will hereinafter refer to the mixing of primary materials and secondary materials. It will be understood, however, that the distinction herein between the primary materials and the secondary materials is the point at which each enters mixing apparatus 10. In addition, once the primary and secondary materials are combined by mixing apparatus 10, they will collectively be referred to as the "mixed materials." Also, the primary and secondary materials will generically be referred to as the "materials."

The continuous static mixing apparatus 10 includes at least one material supply 50 for the primary materials (not shown), at least one material supply 60 for the secondary materials (not shown), at least one mixing disk 20, a disk housing 160 for each at least one mixing disk 20, interconnecting flow communication passageways 70, and an outlet 110. An alternate embodiment also includes an eductor 120. It is understood that each primary and secondary material may have its own primary and secondary material supply, 50 and 60.

Figure 5:
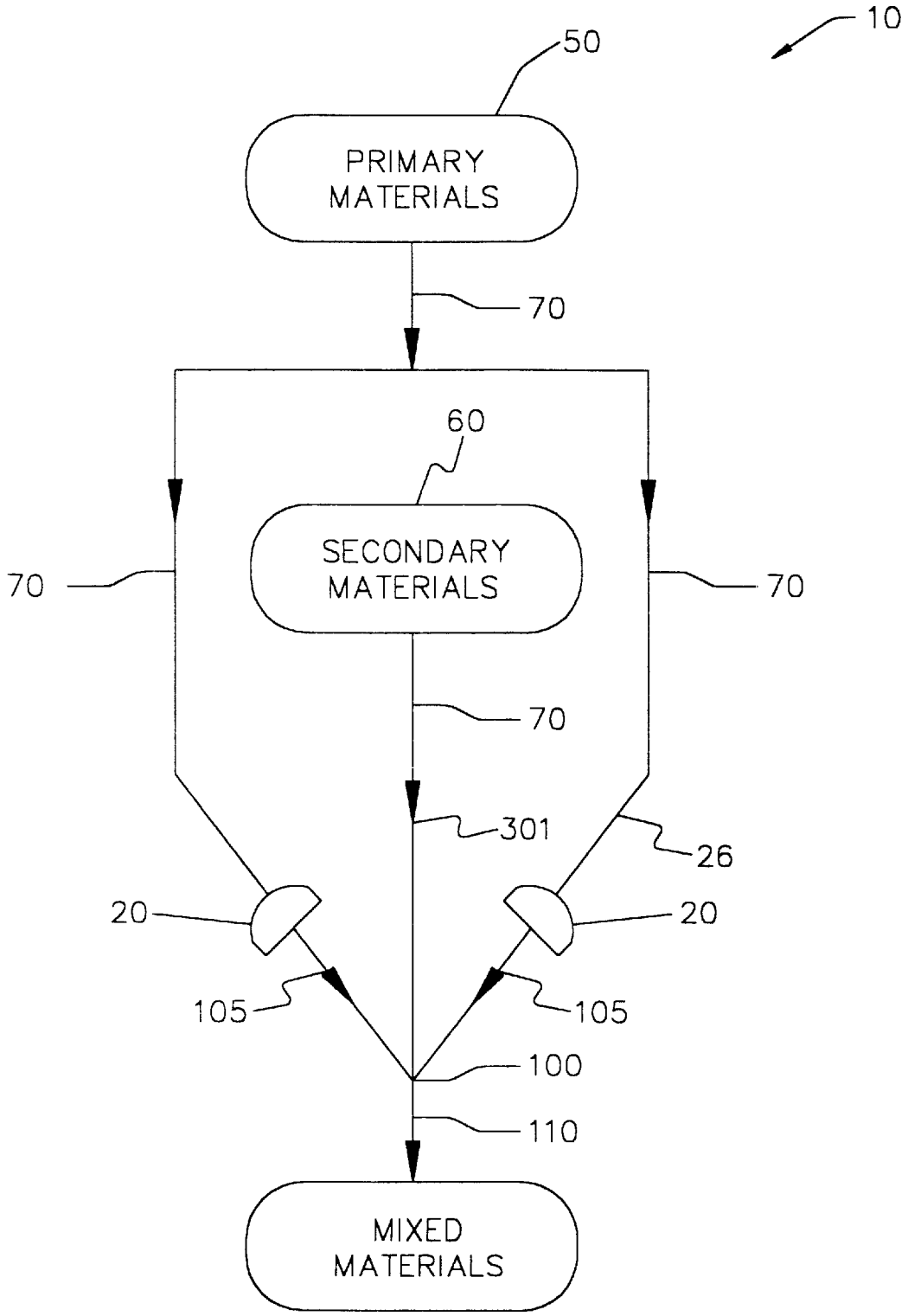
FIG. 5 is a schematic of the preferred embodiment of the continuous static mixing apparatus shown in FIG. 1.
Figure 6:
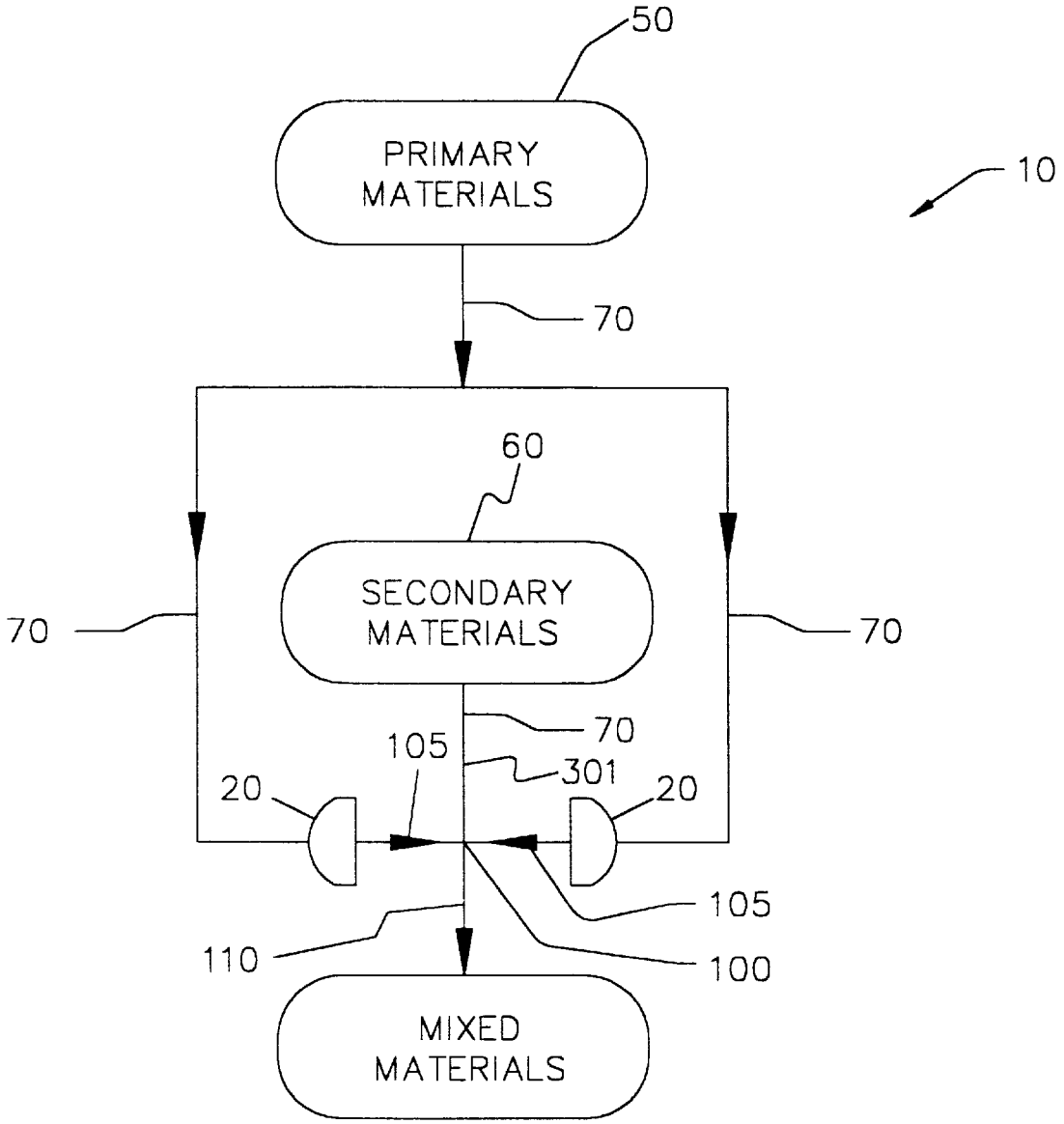
FIG. 6 is a schematic of a preferred embodiment of the continuous static mixing apparatus wherein the secondary material is added downstream of the mixing disks and the angle of flow intersection between the flows of each disk is 180 degrees.
Figure 7:
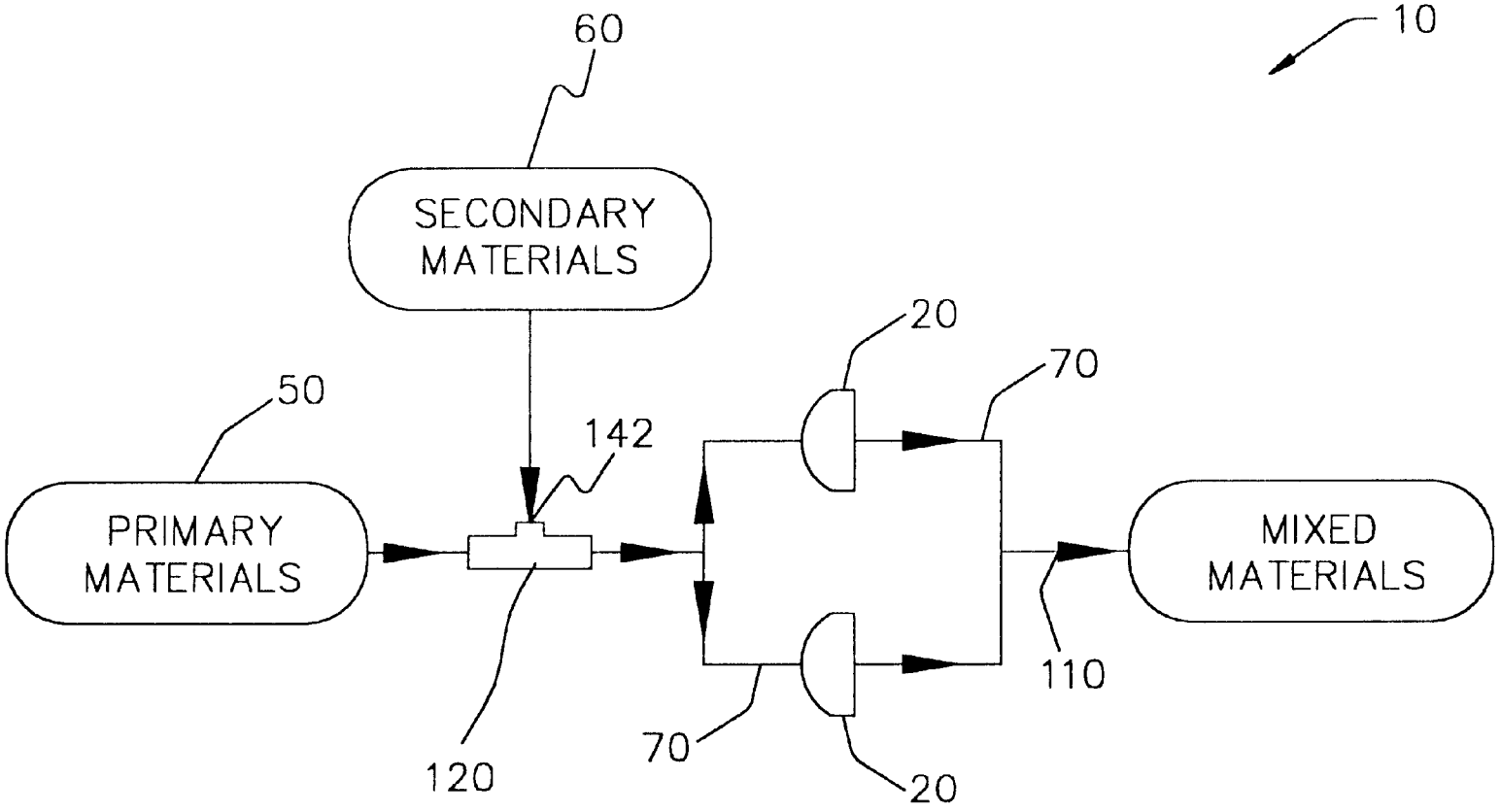
FIG. 7 is a schematic of a preferred embodiment of the continuous static mixing apparatus wherein the primary and secondary materials are combined upstream of the mixing disks.
Figure 10:
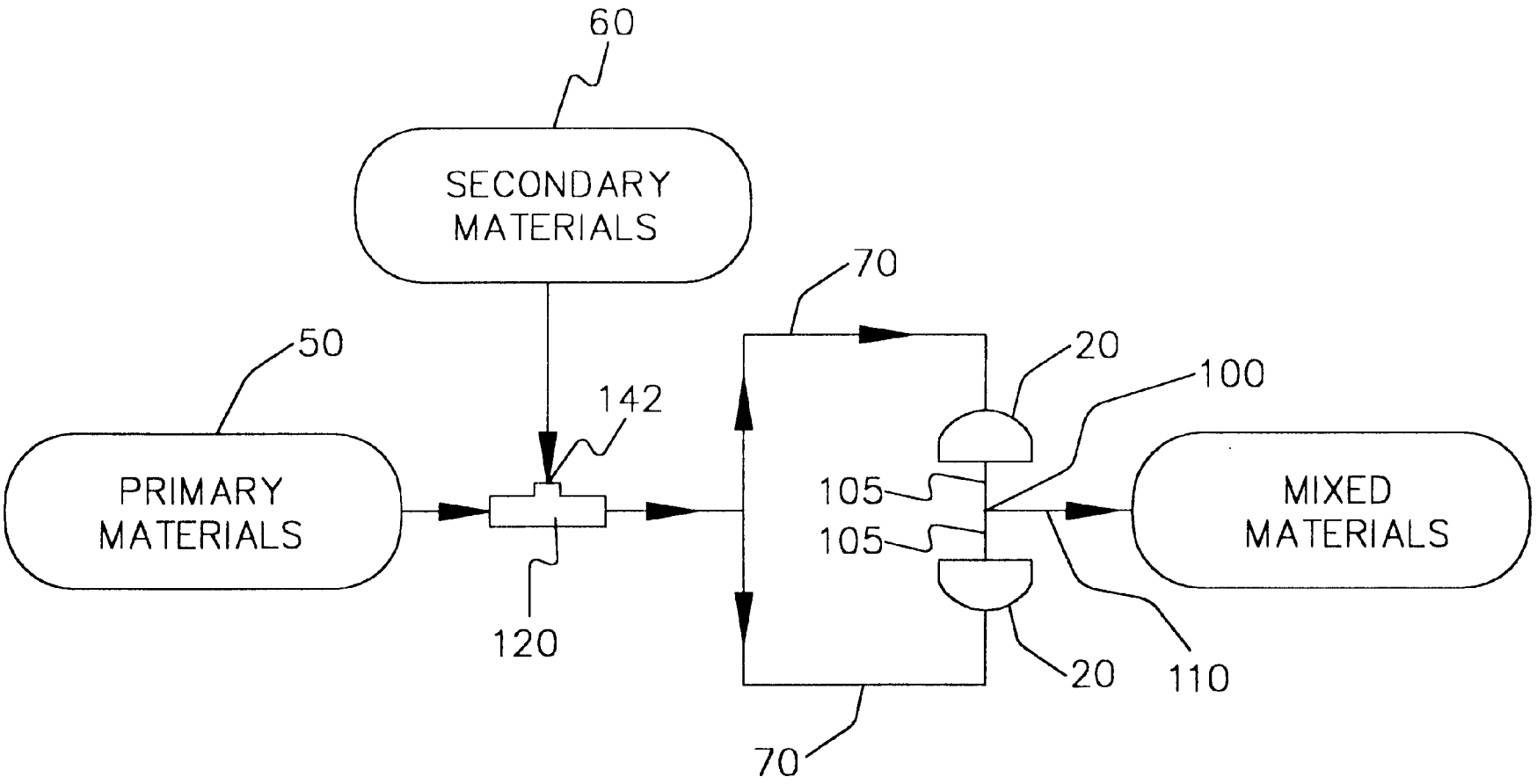
FIG. 10 is a schematic of a preferred embodiment of the continuous static mixing apparatus wherein the primary and secondary materials are combined upstream of the mixing disks and are completely mixed in a merging chamber.

Generally, interconnecting flow communication passageways 70 provide fluid communication between the primary materials supply 50, each of the disk housings 160 with mixing disks 20 therein, and outlet 110. Thus, the primary materials flow within interconnecting flow communication passageways 70 from their respective material supply 50 through each of the at least one disk housings 160 with mixing disks 20 therein and then to outlet 110. Continuous static mixing apparatus 10 mixes the primary and secondary materials together before the mixed materials exit outlet 110. In one embodiment of the invention, as shown in FIGS. 7 and 10, the secondary materials enter mixing apparatus 10 and the primary and secondary materials are combined prior to reaching the mixing disks 20. In another embodiment of the invention, as shown in FIGS. 1, 5, and 6, the secondary materials enter mixing apparatus 10 and the primary and secondary materials are combined after passing through the mixing disks 20.

The function of mixing disk 20 is to provide increased turbulence to the flow of materials therethrough and to increase the mixing of the materials. Each of the mixing disks 20 includes a plurality of nozzles 30 therethrough and a director means 80.

Structurally, each mixing disk 20 is disc shaped and includes an outer surface 180. Each of the mixing disks 20 has an upstream side 22, a downstream side 24, and an axis 26 extending in the direction of the flow of materials through the mixing disk 20. Upstream side 22 is the side of the mixing disk 20 through which the materials enter the mixing disk 20. Downstream side 24 is the side of the mixing disk 20 through which the materials exit the mixing disk 20.

Each mixing disk 20 includes an outer ring 182 extending outward from the outer surface 180. The outer ring 182 includes a lower outer ring surface 183 and an upper outer ring surface 184. The outer surface 180 is thus divided into two sections by outer ring 182: a lower outer surface 189 located below the outer ring 182 and an upper outer surface 188 located above the outer ring 182.

Each mixing disk includes at least one, but preferably two, mixing disk holes 191. In one embodiment shown in FIG. 13, each mixing disk hole 191 extends through outer ring 182 from upper outer ring surface 184 to lower outer ring surface 183. In another embodiment (not shown), each mixing disk hole 191 extends from lower outer ring surface 183 and only partially through outer ring 182. In a preferred embodiment, the two mixing disk holes 191 are diametrically opposed to each other.

A plurality of nozzles 30 having cavities 32 therethrough extend through each of the mixing disks 20. The nozzles 30 may be fixedly attached to the mixing disk 20, removably attached to the mixing disk 20, or may be an integral part of the mixing disk 20.

Each of plurality of nozzles 30 includes a nozzle axis 35 which is preferably parallel to the axis 26 of the mixing disk 20 and equidistant therefrom. Preferably, the nozzles 30 are constructed substantially identical to one another and are dispersed about the mixing disk 20 axis in a symmetrical pattern. In the preferred embodiment, mixing disk 20 has four identical nozzles 30 positioned at 90 degrees from one another having axes 35 parallel to the mixing disk 20 axis 26 and that are equidistantly spaced therefrom.

The cavity 32 extending through each of the nozzles 30 defines in each nozzle 30 an inlet orifice 36 on the upstream side 22 of the mixing disk 20 and an outlet orifice 38 on the downstream side 24 of the mixing disk 20. To provide for acceleration of the materials through the nozzles 30, the cross sectional area of the inlet orifice 36 is greater than the cross sectional area of the outlet orifice 38. Preferably, the inlet orifice 36 has a substantially circular cross section, and the outlet orifice 38 has a noncircular cross section. In the preferred embodiment, the outlet orifice 38 cross-sectional shape has two elongated slots 40 with rounded ends 42. Elongated slots 40 are perpendicular to one another and that bisect one another (a cross-elliptic shape). Although the cavity 32 of each nozzle 30 may have parallel walls 34, in the preferred embodiment, the cavity 32 is tapered to provide for a smooth transition between the nozzle inlet orifice 36 and the nozzle outlet orifice 38.

A director means 80 is attached to upstream side 22 of mixing disk 20. Director means 80 facilitates distribution of the materials entering the mixing disk 20 into the nozzle inlet orifices 36. In one embodiment, director means 80 comprises a nose cone type flow director body 82 that directs the flow of materials toward the nozzle inlet orifices 36 and facilitates a more laminar flow into the nozzles 30.

In structure, the director body 82 has a first director end 84 and a second director end 86. First director end 84 is the end of director body 82 through which the materials enter director body 82 and is distal mixing disk 20. Second director end 86 is the end of director body 82 through which the materials exit director body 82 and is proximal mixing disk 20. First director end 84 terminates in an arcuate cone 90. The cross-sectional diameter of the director body 82 gradually increases from first director end 84 to second director end 86 so that, at the outer perimeter 88 of second director end 86, director body 82 surrounds the plurality of nozzles 30.

Director body 82 also includes blades 92 that extend between the nozzles 30 and define openings 96 therebetween. Each blade has radial axes 37. Preferably, blades 92 increase in width in the radial direction from first director end 84 toward the outer perimeter 88 of the second director end 86. openings 96 provide unimpeded flow paths into the nozzle inlets 36. In other words, the director body 82 does not extend over nozzle inlet orifices 36 in the direction of the flow. However, the blades 92 substantially prevent the flow from striking the upstream side 22 of the mixing disk 20 between the nozzles 30 and, thereby, creating turbulence at the entrance to the nozzles 30. Instead, director body 82 guides the material entering mixing disk 20 to flow without obstruction into the nozzle inlet orifices 36. The number of openings 96 provided on director body 82 corresponds to the number of nozzles 30 mounted on director body 82. Each opening 96 corresponds to one nozzle 30.

Figure 11:
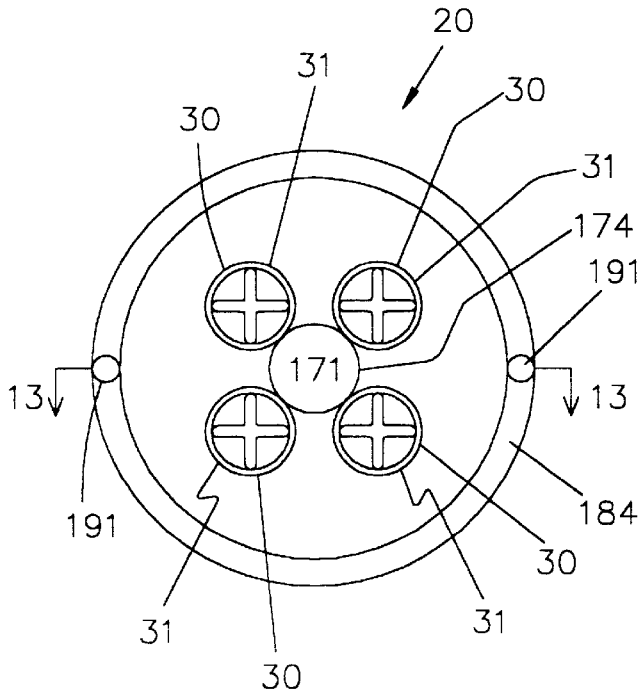
FIG. 11 is a top view of an alternative embodiment of the director means on the mixing disk.
Figure 12:
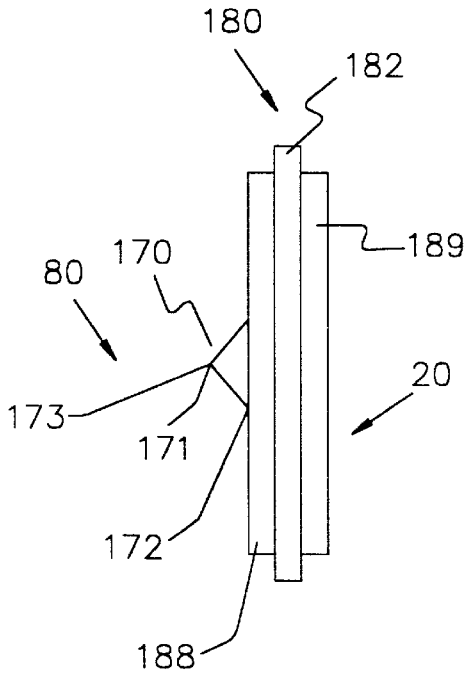
FIG. 12 is a side view of the director means and mixing disk of FIG. 11.
Figure 13:
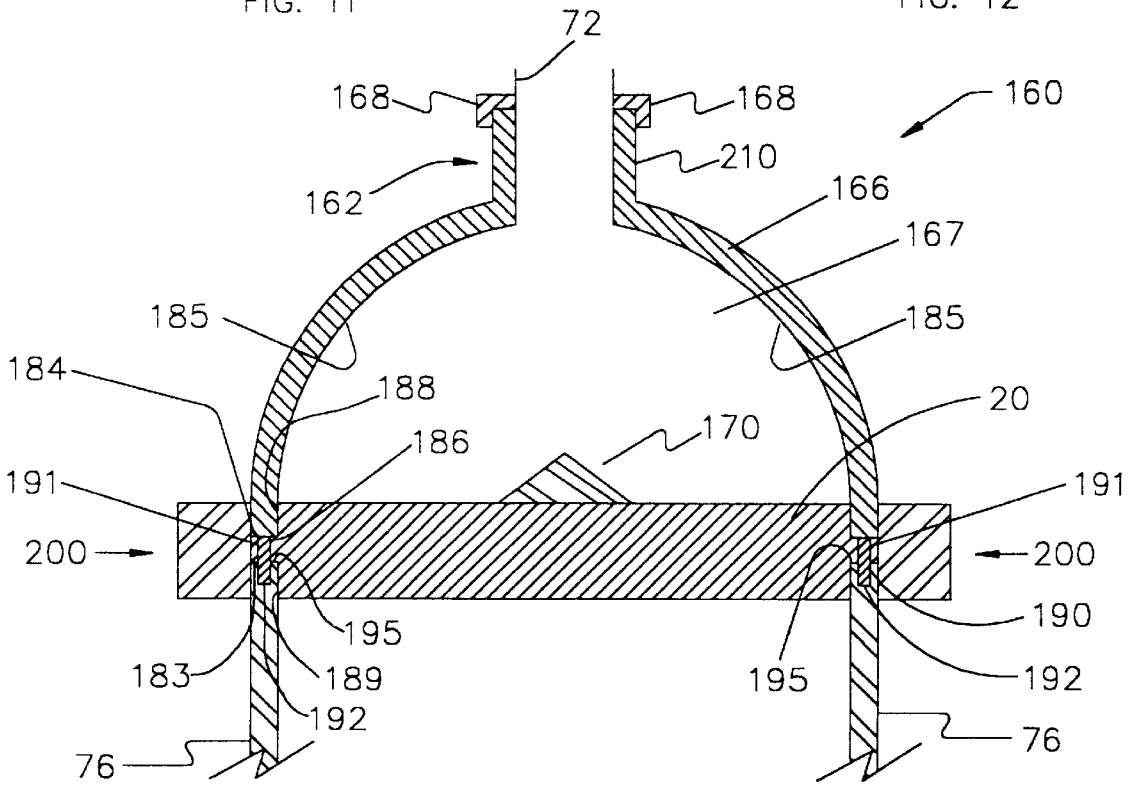
FIG. 13 is a cross-sectional view of the mixing disk taken along line 13—13 of FIG. 11 together with the disk housing and as attached to outlet communication passageway.

In an alternative embodiment, as shown in FIGS. 11–13, director means 80 comprises a conical section 170. Conical section 170 also directs the flow of materials toward the nozzle inlet orifices 36 and facilitates a more laminar flow into the nozzles 30. In structure, conical section 170 has a first conical end 171 and a second conical end 172. First conical end 171 is the end of conical section 170 distal mixing disk 20. Second conical end 172 is the end of conical section 170 proximal and attached to mixing disk 20.

Second conical end 172 is attached to the center of mixing disk 20 so that it is adjacent the outer circumference 31 of all nozzles 30. First conical end 171 terminates in an arcuate cone 173. The cross sectional diameter of the conical section 170 gradually increases from first conical end 171 to second conical end 172 so that the outer edge 174 of second conical end 172 is within the nozzles 30 adjacent to all the nozzle outer circumferences 31.

Interconnecting flow communication passageways 70 include inlet and outlet communication passageways, 72 and 76, proximal the mixing disk 20. Inlet communication passageway 72 is connected to and in fluid communication with a first end 162 of disk housing 160 and upstream side 22 of at least one mixing disk 20. Outlet communication passageway 76 is connected to and in fluid communication with a second end 164 of disk housing 160 and is thus also in fluid communication with downstream side 24 of at least one mixing disk 20. Outlet communication passageway 76 also includes at least one, and preferably two, holes 192. Each outlet communication passageway hole 192 extends from an outlet communication passageway top end 195 in a direction parallel to and partially into outlet communication passageway 76.

Inlet and outlet communication passageways, 72 and 76, respectively include inlet and outlet communication passageway walls, 74 and 78. Preferably, inlet and outlet communication passageway walls, 74 and 78, are parallel to the axis 26 of the mixing disk 20.

Figure 14:
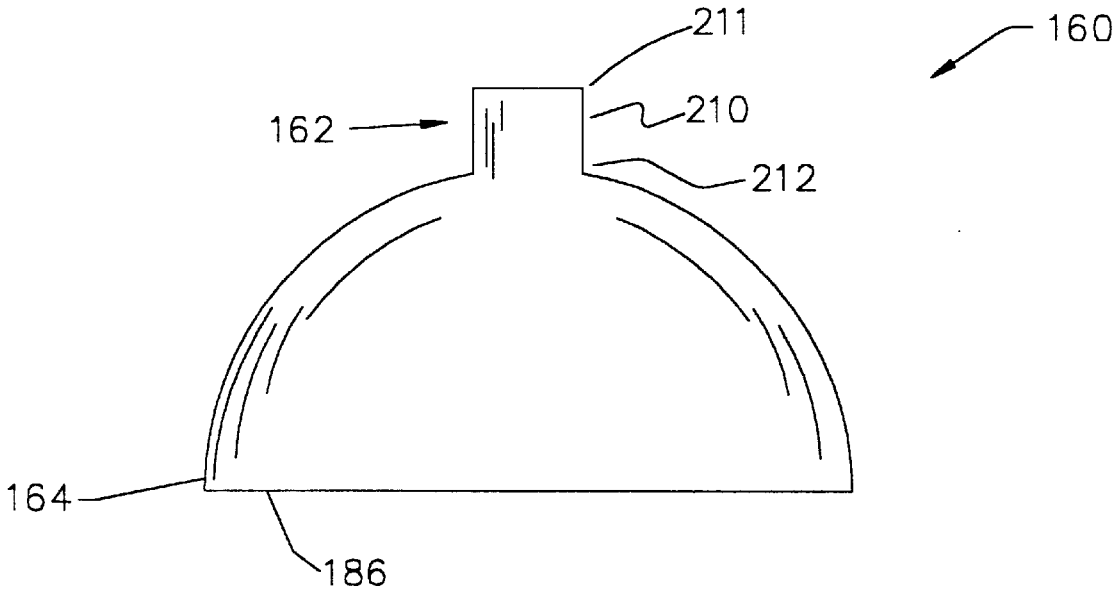
FIG. 14 is a side view of the disk housing.
Figure 15:
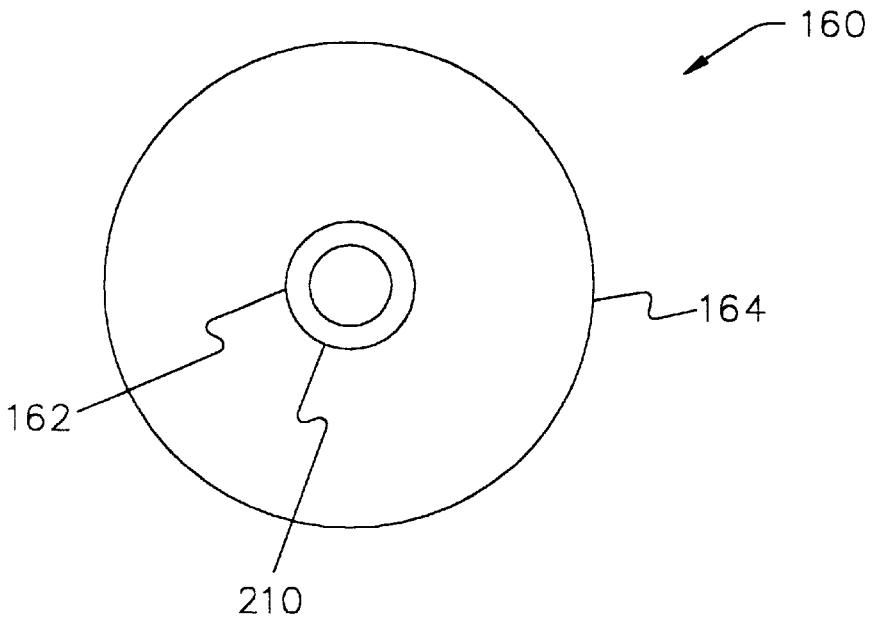
FIG. 15 is a top view of the disk housing.

Each mixing disk 20 is surrounded and housed by a disk housing 160, as shown in FIGS. 13–15. Disk housing 160 is preferably constructed of plastic or steel and has a thickness 166 thereby defining a disk housing interior 167. Disk housing 160 includes a first end 162, a second end 164, a lower end 186, and an inner end 185.

Disk housing first end 162 is the end of the disk housing 160 through which the materials enter disk housing 160 and is in fluid communication with inlet communication passageway 72. Disk housing first end 162 includes a tubular section 210 having a first and second end, 211 and 212. First tubular section end 211 is distal the remainder of the disk housing 160 while second tubular section end 212 is proximal the remainder of disk housing 160.

Disk housing second end 164 is the end of the disk housing 160 through which the materials exit disk housing 160 and is in fluid communication with outlet communication passageway 76. In a preferred embodiment, the cross sectional diameter of disk housing 160 gradually increases from the second tubular section end 212 of disk housing first end 162 to disk housing second end 164 so that the cross-sectional diameter of disk housing second end 164 is substantially the same as the cross-sectional diameter of mixing disk 20.

Disk housing lower end 186 is defined by the disk housing thickness 166 and disk housing second end 164. Disk housing inner end 185 comprises the interior surface of disk housing 160.

Disk housing first end 162 includes a first end passageway connector means 168. First end passageway connector means 168 connects inlet communication passageway 72 and disk housing interior 167. In a preferred embodiment, first end passageway connector means 168 comprises a clamp-like attachment (not shown) which clamps the disk housing first end 162 to the inlet communication passageway 72. Such clamp-like attachments are all well-known to a person having ordinary skill in the art.

A second end passageway connector means 200 connects disk housing second end 164 and outlet communication passageway 76 and secures mixing disk 20 therein. As can be seen from FIG. 13, mixing disk 20 is positioned within outlet communication passageway 76 so that the lower outer ring surface 183 abuts the top end 195 of outlet communication passageway 76. Thus, the lower outer surface 189, the part of the outer surface 180 below outer ring 182, is positioned within outlet communication passageway 76. Disk housing second end 164 is then placed on top of mixing disk 20 so that disk housing lower end 186 abuts upper outer ring surface 184 and so that disk housing inner end 185 abuts upper outer surface 188.

In a preferred embodiment, second end passageway connector means 200 comprises a clamp-like attachment 201, a pin 190, the outlet communication passageway holes 192, and the mixing disk holes 191 on outer ring 182. The holes, 191 and 192, are positioned so that once mixing disk 20 is in place on outlet communication passageway 76, the holes, 191 and 192, are aligned. Pin 190 may then be inserted into the aligned holes, 191 and 192, and disk housing 160 placed on top of mixing disk 20 as described previously. Clamp-like attachment 201 is then attached around the exterior of the connection between disk housing 160, mixing disk 20, and outlet communication passageway 76. Clamp-like attachment 201 comprises any clamp or similar clamping mechanism, all well-known to a person with ordinary skill in the art. Second end passageway connector 200 thus securely connects disk housing 160, mixing disk 20, and outlet communication passageway 76. If mixing disk hole 191 does not extend through outer ring 182 (embodiment not shown), then pin 190 is first placed in outlet communication passageway hole 192 and mixing disk 20 is placed on top so that pin 190 also penetrates mixing disk hole 191.

Preferably, the continuous static mixing apparatus 10 utilizes two mixing disks 20. However, the arrangement and relative positioning of the two mixing disks 20 may vary to provide different results for the intermixing of the nozzle outlet flows.

In the embodiment shown in FIG. 7, the mixing apparatus 10 includes two parallel interconnecting flow communication passageways 70 wherein the outlet streams of the mixing disks 20 merge at some predetermined point downstream of the mixing disks 20. In this embodiment, the independent outlet flows from the separate mixing disks 20 do not interact, but simply create independent turbulent outlet flows that merge after mixing.

In another embodiment as shown in FIGS. 1, 5, 6, and 10, the mixing apparatus 10 includes mixing disks 20 positioned such that their outlet flows intersect and interact with one another. The mixing apparatus 10 maintains the two mixing disks 20 relatively close together and their respective flows intersect and interact in a merging chamber 100. Interconnecting flow communication passageways 70 include an inlet merging chamber passageway 105 for each mixing disk 20. Each inlet merging chamber passageway 105 provides fluid communication between its corresponding mixing disk 20 and merging chamber 100. Preferably, in this intersecting flow design, the inlet merging chamber passageways 105 are relatively straight from the mixing disk 20 to the merging chamber 100.

The angle of flow intersection at the merging chamber 100 may vary. Two illustrated embodiments utilize flow intersection angles of 90 degrees and 180 degrees respectively. With a 90 degree intersection angle, as shown in FIGS. 1 and 5, the outlet flows intermix and merge to create a single output flow. The output flow uses the energy of the combined flows to facilitate movement through the apparatus outlet 110. With the 180 degree intersection angle, as shown in FIGS. 6 and 10, the outlet flows collide directly. After colliding and mixing, the mixed materials flow out of the mixing apparatus 10 through the apparatus outlet 110.

As previously disclosed herein, mixing apparatus 10 generally falls into two broad categories of preferred embodiments. The first category of mixing apparatus 10 combines the materials before the materials pass through the mixing disk 20. The second category of mixing apparatus 10 combines the materials downstream of the mixing disk 20 in the area of increased turbulent flow.

Figure 8:
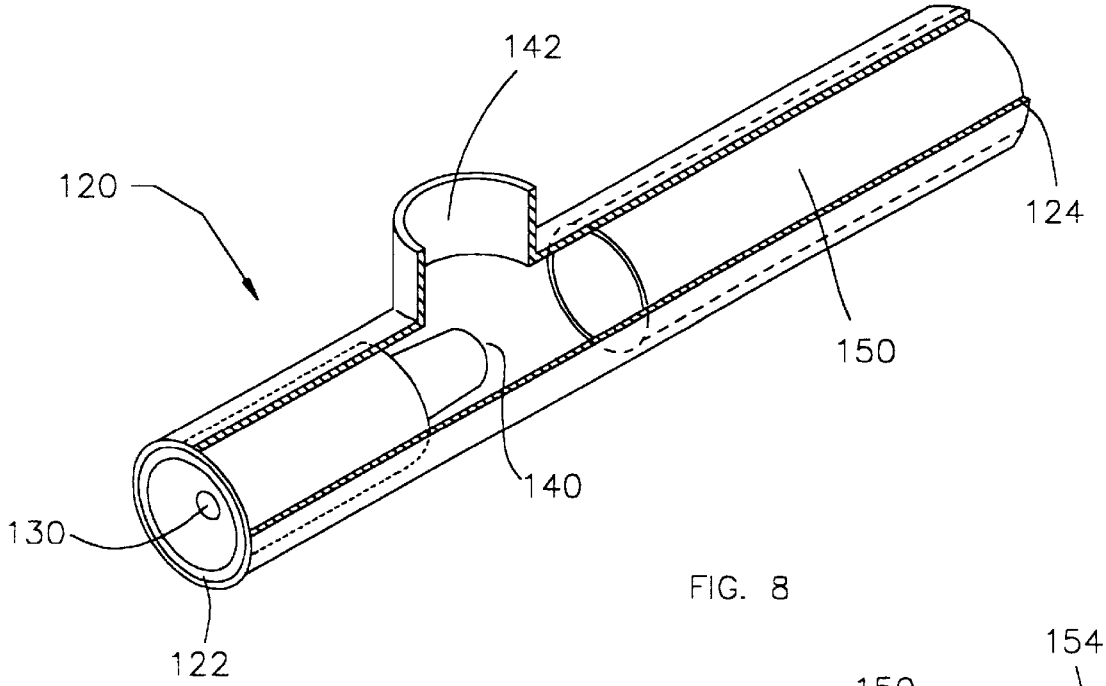
FIG. 8 is a partial cross-sectional view of the eductor.
Figure 9:
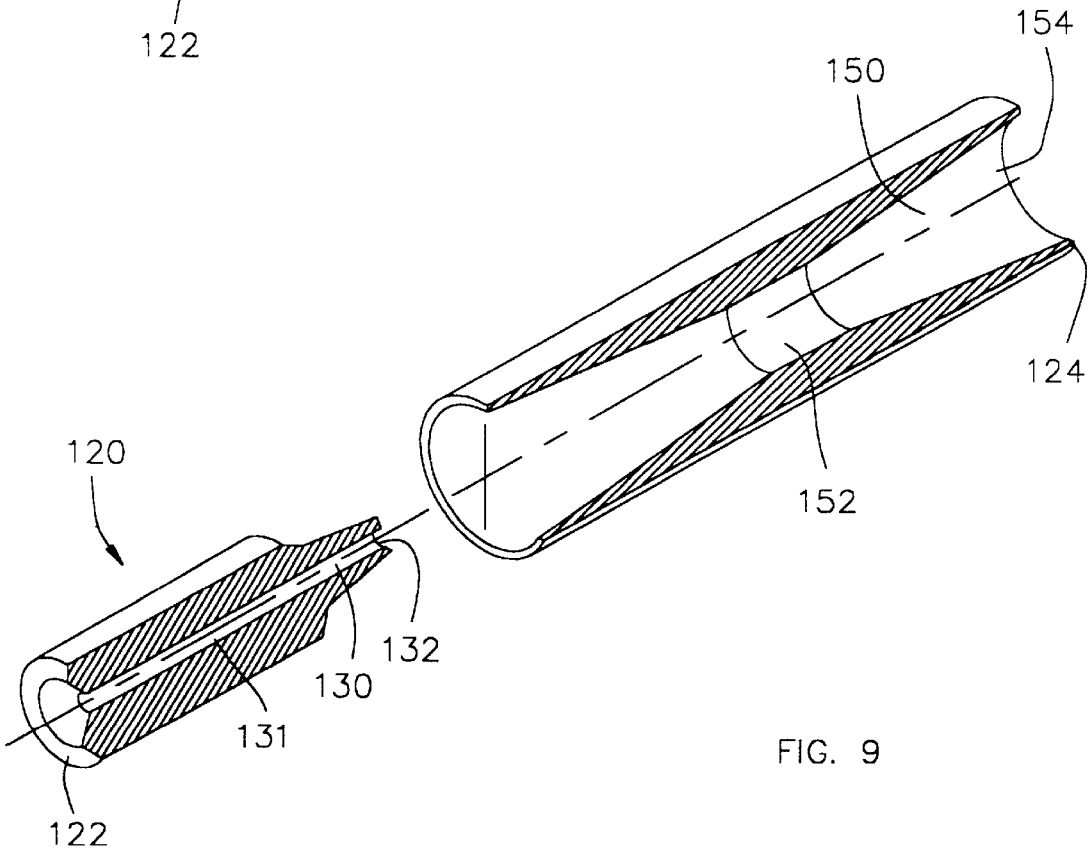
FIG. 9 is a partial cross-sectional view of the nozzle and the diffuser components of the eductor.

The first category of mixing apparatus 10 (combines the materials before the mixing disks 20), as shown in FIGS. 7 and 10, may utilize an eductor 120 to entrain the primary and secondary materials. Turning to FIGS. 8 and 9, the eductor 120 includes a first eductor end 122, a second eductor end 124, and an eductor nozzle 130. First eductor end 122 of eductor 120 is in fluid communication with the primary materials supply 50 and is the end of eductor 120 through which the primary materials enter eductor 120. Eductor nozzle 130 is located within eductor 120. Eductor nozzle 130 includes a cavity 131 therethrough which defines a nozzle outlet 132 at the eductor nozzle 130 end distal first eductor end 122. Mixing chamber 140 is located intermediate nozzle outlet 132 and second eductor end 124.

For increased turbulence within mixing chamber 140, the mixing chamber 140 cross sectional area is greater than the cross sectional area of the nozzle outlet 132. Nozzle 130 preferably has a noncircular outlet 132.

Eductor 120 also includes at least one second material inlet 142 which provides fluid communication between the mixing chamber 140 and the secondary materials supply 60. In mixing chamber 140, the primary materials mix with the secondary materials.

Eductors 120 generally include a diffuser 150 used for recovery of material flow pressure. Diffuser 150 has a diffuser inlet end 152 and a diffuser outlet end 154, each end, 152 and 154, having a cross sectional area. Diffuser inlet end 152 is the end of diffuser 150 through which the mixed materials enter diffuser 150. Diffuser outlet end 154 is the end of diffuser 150 through which the mixed materials exit diffuser 150 and coincides with second eductor end 124. The cross sectional area of diffuser inlet end 152 is smaller than the cross sectional area of diffuser outlet end 154. In addition, diffuser 150 includes a smooth transitional taper from diffuser inlet end 152 to diffuser outlet end 154.

In this first category of mixing apparatus 10 (combines the materials before the mixing disks 20), interconnecting flow communication passageways 70 provide fluid communication between second eductor end 124 and mixing disks 20. In a mixing apparatus 10 having a plurality of mixing disks 20, the communication passageways 70 divide the flow of mixed materials exiting eductor 120 into the passageways leading to the mixing disks 20. In the embodiment not including a merging chamber 100, once through the mixing disks 20, the flows recombine and the mixed materials exit through the apparatus outlet 110. In the embodiment including a merging chamber 100, the flow of materials through the mixing disks 20 interact at merging chamber 100, wherein the materials become completely mixed, and then exit through the apparatus outlet 110.

In the second broad category of mixing apparatus 10 (combines the materials after the mixing disks 20), the mixing apparatus 10 introduces the secondary materials into the primary materials after the primary materials exit mixing disks 20. The secondary materials supply 60 is in direct fluid communication with merging chamber 100 by way of secondary material supply passageway 301. Preferably, in this embodiment, the flow of primary materials through each of the mixing disks 20 is equal.

The sizes and weights of the parts are relatively small to facilitate portability of the mixing apparatus 10.

In the first category (FIGS. 7 and 10), the primary materials supply 50 is connected to and is in fluid communication with first eductor end 122. Primary materials are conducted under pressure from primary materials supply 50 into eductor 120 through first eductor end 122. After passing through first eductor end 122, the primary materials enter eductor nozzle 130. The flow of primary materials is accelerated upon discharge from nozzle outlet 132 into mixing chamber 140.

The secondary materials supply 60 is connected to and is in fluid communication with second material inlet 142, which in turn is connected to and in fluid communication with mixing chamber 140. Secondary materials are drawn into mixing chamber 140 through second material inlet 142.

Turbulent flow within mixing chamber 140 results in at least partial mixing of the primary materials and the secondary materials.

After leaving mixing chamber 140, the mixed materials enter diffuser 150 at diffuser inlet end 152. As the mixed materials flow through the smooth tapered diffuser 150, the mixed materials recover some of the pressure which was lost due to the turbulence within mixing chamber 140. After passing through diffuser 150, the mixed materials exit eductor 120 at second eductor end 124.

A pair of interconnecting flow communication passageways 70 are in fluid communication with second eductor end 124 and divide the flow of mixed materials out of eductor 120. Each interconnecting passageway 70 is also connected to and is in fluid communication with a disk housing 160 with a mixing disk 20 therein. Thus, as the mixed materials flow out of second eductor end 124, the flow of mixed materials is equally divided by the interconnecting passageways 70. In turn, the mixed materials within each interconnecting passageway 70 flow into a disk housing 160 through disk housing first end 162 by way of the corresponding inlet communication passageway 72.

In the embodiment in which director means 80 comprises director body 82, once within disk interior 167, as the mixed materials approach mixing disk 20, the mixed materials encounter the first director end 84 of director body 82. By including blades 92 and openings 96 therebetween, director body 82 functions to guide the flow of mixed materials into the plurality of nozzles 30 extending through mixing disk 20. Because director body 82 is cone shaped and the tip of the cone coincides with the first director end 84, the mixed materials, upon hitting first director end 84, are diverted into the openings 96 included between the blades 92 of director body 82. As previously disclosed, each opening 96 corresponds to one nozzle 30. Thus, the mixed materials flow through each opening 96 and into the corresponding nozzle 30. Thereby, director body 82 reduces turbulence at the upstream side 22 of mixing disk 20.

In the embodiment in which director means 80 comprises conical section 170, once within disk interior 167, as the mixed materials approach mixing disk 20, the mixed materials encounter the first conical end 171 of conical section 170. Conical section 170 functions to guide the flow of mixed materials into the plurality of nozzles 30 extending through mixing disk 20. Because conical section 170 is cone shaped and the tip of the cone coincides with the first conical end 171, the mixed materials, upon hitting first conical end 171, are diverted into the nozzles 30. Thereby, conical section 170 reduces turbulence at the upstream side 22 of mixing disk 20.

After being diverted into the nozzles 30 by director means 80, the mixed materials enter the corresponding nozzle 30 at nozzle inlet orifice 36. The flow of the mixed materials is accelerated at nozzle outlet orifice 38.

The configuration and cross-sectional shape of nozzle outlet orifice 38 generates a discharge stream which further mixes the materials producing a flow of mixed materials which contains cross-flow, axial vortices. The nozzle outlet orifice 38 generates strong, radial vortical structures that expand and create a non-uniform shear layer within the flow of mixed materials. The large scale vortices within the flow of mixed materials function to provide further "bulk mixing" to the mixed materials. Furthermore, the large scale vortices generated by the nozzle outlet orifice 38 influence the development of small scale vortices within the flow of mixed materials. The small scale vortices also aid in the further mixing of the materials in that they function to provide "molecular diffusion", or mixing in the molecular level, within the mixed materials.

It should be noted that the amount of mixing within the discharge flow is related to the shear layer thickness generated in the flow of materials by nozzle outlet orifice 38. In turn, the shear layer thickness is affected by the cross sectional area of the nozzle outlet orifice 38. It has been found that the cross-elliptic shape of the nozzle outlet orifice 38 imparts a substantial amount of shear layer thickness to the flow of materials. Each ellipse of the cross-elliptic shape includes a major and minor axis with improved enhancement and mixing occurring along both axes of the ellipse. It has been observed that significantly more entrainment and mixing occurs along the minor axis of each ellipse than along the major axis.

In the embodiment in which the flows from mixing disks 20 do not collide in merging chamber 100, as shown in FIG. 7, additional interconnecting flow communication passageways 70 are connected to and are in fluid communication with the disk housing second end 164 (and are thus also in fluid communication with the downstream side 24 of each mixing disk 20) so that, after exiting nozzles 30, the materials flow into such additional interconnecting flow communication passageways 70 by way of outlet communication passageway 76. At some point, the additional interconnecting flow communication passageways 70 out of the mixing disks 20 combine to reunite the entire flow of fully mixed materials. After such combination point, the mixed materials exit the mixing apparatus 10 through the apparatus outlet 110.

In the embodiment in which the flows from mixing disks 20 collide at merging chamber 100, as shown in FIG. 10, the mixed materials flow out of each mixing disk 20 into the corresponding inlet merging chamber passageway 105 by way of outlet communication passageway 76. Inlet merging chamber passageway 105 is connected to and in fluid communication with the downstream side 24 of its corresponding mixing disk 20 and with merging chamber 100. Thus, the mixed materials flow out of mixing disk 20, within inlet merging chamber passageway 105, and into merging chamber 100.

The inlet merging chamber passageways 105 are oriented so that their respective flows of mixed materials intersect and interact in the merging chamber 100. In this embodiment, the merging chamber 100 acts as a chemical reactor to the opposing flows of mixed materials. The cross-flow, axial vortices imparted to the flow of mixed materials by the nozzle 30 provide the momentum for a "collision exchange" between the opposing flows of mixed materials. The impingement of the flows of mixed materials produces an abrupt pressure differential. In turn, the abrupt pressure differential produces dramatic interfacial stress, a vortical interaction between the two flows, and molecular dispersion within the mixed materials thereby engulfing and mixing the surrounding materials in a confined enclosure. Furthermore, the flows of mixed materials exiting nozzle 30 are characterized by high mass transport coefficients which coefficients are abruptly reduced upon the impingement of the two flows. The abrupt decrease in transport coefficients and the rapid increase in interfacial stress within the mixed materials creates a self-inducing and merging of the two energized flows of mixed materials. In addition, the "collision exchange" between the two opposing flows of mixed materials causes radial fluid growth and turbulent spreading of the two flows. Thus, the primary and secondary materials are fully mixed.

An additional interconnecting flow communication passageway 70 is connected to and in fluid communication with the merging chamber 100 so that, after interacting within merging chamber 100, the now fully mixed materials flow into such additional interconnecting flow communication passageways 70. At some point, the additional interconnecting flow communication passageway 70 leads the mixed materials towards apparatus outlet 110. The mixed materials thus exit the mixing apparatus 10 at the apparatus outlet 110.

In the second broad category (those which combine the materials after the mixing disks 20 as illustrated in FIGS. 1, 5, and 6), primary materials supply 50 is connected to and is in fluid communication with an interconnecting flow communication passageway 70. The primary materials supply 50 dispenses the primary materials under pressure into interconnecting flow communication passageway 70. At some point downstream of the primary materials supply 50, interconnecting flow communication passageway 70 divides into a pair of interconnecting flow communication passageways 70 thereby also dividing the flow of primary materials therein. Each of the pair of interconnecting flow communication passageways 70 is also connected to and in fluid communication with a disk housing 160 with a mixing disk 20 therein. Thus, as the primary materials flow out of the primary materials supply 50, the flow of primary materials is divided by the pair of interconnecting flow communication passageways 70. In turn, having been divided, the primary materials within each of the first pair of interconnecting flow communication passageways 70 flow into the disk housing 160 at disk housing first end 162 through that mixing disk's 20 inlet communication passageways 72.

In the embodiment in which director means 80 comprises director body 82, once within disk interior 167, as the primary materials approach mixing disk 20, the primary materials encounter the first director end 84 of director body 82. By including blades 92 and openings 96 therebetween, director body 82 functions to guide the flow of primary materials into the plurality of nozzles 30 extending through mixing disk 20. Because director body 82 is cone shaped and the tip of the cone coincides with the first director end 84, the primary materials, upon hitting first director end 84, are uniformly diverted into the openings 96 included between the blades 92 of director body 82. As previously disclosed, each opening 96 corresponds to one nozzle 30. Thus, the mixed materials flow through each opening 96 and into the corresponding nozzle 30. Thereby, director body 82 reduces turbulence at the upstream side 22 of mixing disk 20.

In the embodiment in which director body means 80 comprises conical section 170, once within disk interior 167, as the primary materials approach mixing disk 20, the primary materials encounter the first conical end 171 of conical section 170. Conical section 170 functions to guide the flow of primary materials into the plurality of nozzles 30 extending through mixing disk 20. Because conical section 170 is cone shaped and the tip of the cone coincides with the first conical end 171, the primary materials, upon hitting first conical end 171, are uniformly diverted into the nozzles 30. Thereby, conical section 170 reduces turbulence at the upstream side 22 of mixing disk 20.

After being diverted into the nozzles 30 by director means 80, the primary materials enter the corresponding nozzle 30 at nozzle inlet orifice 36. The flow of primary materials is accelerated at nozzle outlet orifice 38.

The configuration and cross-sectional shape of nozzle outlet orifice 38 generates a discharge stream which prepares the primary materials for mixing with the secondary materials producing a flow of primary materials which contains cross-flow, axial vortices. The nozzle outlet orifice 38 generates strong, radial vortical structures that expand and create a non-uniform shear layer within the flow of primary materials that provide large-scale "bulk" mixing in the flow. Additional, small scale vortices induced by the larger scale vortices provide molecular diffusion within the flow.

The primary materials flow out of disk housing second end 164 and each mixing disk 20 into the corresponding inlet merging chamber passageway 105 by way of outlet communication passageway 76. Inlet merging chamber passageway 105 is in fluid communication with the downstream side 24 of its corresponding mixing disk 20 and with merging chamber 100. Thus, the primary materials flow out of mixing disk 20, within inlet merging chamber passageway 105, and into merging chamber 100.

The inlet merging chamber passageways 105 are oriented so that their respective flows of primary material intersect and interact in the merging chamber 100.

The secondary materials supply 60 is directly connected to and in fluid communication with merging chamber 100. Secondary materials supply 60 dispenses the secondary materials under pressure into merging chamber 100. Thus, at merging chamber 100, in addition to the flows of primary materials out of the each mixing disks 20 colliding with each other at an angle such as a 90 degree angle (shown in FIG. 5) or a 180 degree angle (shown in FIG. 6), the primary materials intersect and interact with the secondary materials entering merging chamber 100.

The merging chamber 100 acts as a chemical reactor to the opposing flows of primary materials. The cross-flow, axial vortices imparted to the flow of primary materials by the nozzle 30 provide the momentum for a "collision exchange" between the opposing flows of mixed materials. The impingement of the flows of primary materials produces an abrupt pressure differential and imparts a cohesive interaction between the primary and secondary materials. In turn, the abrupt pressure differential produces dramatic interfacial stress, a vortical interaction between the materials, and molecular dispersion within the materials thereby engulfing and mixing the surrounding primary and secondary materials in a confined enclosure. Furthermore, the flows of primary materials exiting nozzle 30 are characterized by high mass transport coefficients in merging chamber 100 which coefficients are abruptly reduced upon the impingement of the two flows of primary materials. The abrupt decrease in transport coefficients and the rapid increase in interfacial stress within the primary materials creates a self-inducing and merging of the two energized flows of primary materials. In addition, the "collision exchange" between the two opposing flows of primary materials causes radial fluid growth and turbulent spreading of the two flows of primary materials together and into the surrounding secondary materials.

It should be noted that the amount of mixing is related to the shear layer thickness generated in the flow of materials by nozzle outlet orifice 38. In turn, the shear layer thickness is affected by the cross sectional area of the nozzle outlet orifice 38. It has been found that the cross-elliptic shape of the nozzle outlet orifice 38 imparts a substantial amount of shear layer thickness to the flow of materials. Each ellipse of the cross-elliptic shape includes a major and minor axis with improved enhancement and mixing occurring along both axes of the ellipse. It has been observed that significantly more entrainment and mixing occurs along the minor axis of each ellipse than along the major axis.

An additional interconnecting flow communication passageway 70 is connected to and in fluid communication with the merging chamber 100 so that, after interacting within merging chamber 100, the now fully mixed materials flow into such additional interconnecting flow communication passageways 70. At some point, the additional interconnecting flow communication passageway 70 leads the mixed materials towards apparatus outlet 110. The mixed materials thus exit the mixing apparatus 10 at the apparatus outlet 110.

The process for continuous static mixing of flowable materials essentially requires combining a plurality of flowable materials in a moving stream and creating turbulence in the stream. Passing the flow through a plurality of nozzles 30 creates the needed turbulence. A mixing disk 20, as described above, positions and maintains the nozzles 30.

The foregoing disclosure and description of the invention is illustrative and explanatory thereof. Various changes in the details of the illustrated construction may be made within the scope of the appended claims without departing from the spirit of the invention. For example, although the specification discloses that mixing disk 20 and director means 80 are two separate parts, it is understood that such parts may be constructed as an integral unit. The present invention should only be limited by the following claims and their legal equivalents.

I claim:

1. A mixing apparatus for mixing primary materials with secondary materials, each of said primary and said secondary materials being flowable, comprising:

at least one mixing disk having an upstream side and a downstream side;

said mixing disk upstream side in fluid communication with a combined flow of said primary and secondary materials;

an outlet allowing the flow of mixed primary and secondary materials;

said mixing disk downstream side in fluid communication with said outlet;

said at least one mixing disk including at least one nozzle allowing flow therethrough;

said at least one nozzle having a cavity extending therethrough;

said cavity defining a nozzle inlet orifice and a nozzle outlet orifice;

said nozzle inlet orifice having an inlet cross-sectional area;

said nozzle outlet orifice having an outlet cross-sectional area;

said inlet cross-sectional area having a generally circular shape;

said outlet cross-sectional area having a non-circular shape; and said inlet cross-sectional area being greater than said outlet cross-sectional area.

2. An apparatus as in claim 1, wherein said cavity being at least partially tapered from said nozzle inlet orifice to said nozzle outlet orifice.

3. An apparatus as in claim 2, wherein:

said outlet cross-sectional area non-circular shape comprising two elongated slots; and each of said two elongated slots being perpendicular to and bisecting the other said elongated slot.

4. An apparatus as in claim 3, wherein:

said at least one mixing disk having a mixing disk axis in the direction of the flow of said primary and secondary materials;

said at least one nozzle having a nozzle axis; and said nozzle axis being parallel to said mixing disk axis.

5. An apparatus as in claim 4, wherein:

said at least one nozzle comprises a plurality of nozzles;

each of said nozzles is identical in construction; and said nozzles are dispersed about said mixing disk axis in a symmetrical pattern.

6. An apparatus as in claim 5, further comprising:

a director means attached to said mixing disk upstream side of said at least one mixing disk; and said director means directing said flow of said combined primary and secondary materials toward said nozzle inlet orifices.

7. An apparatus as in claim 6, wherein said director means comprising:

a director body having a first director end and a second director end;

said director body attached to said mixing disk upstream side at said second director end;

said first director end terminating in an arcuate cone;

said director body having a cross-sectional diameter increasing from said first director end to said second director end; and said director body including a plurality of blades extending in the radial direction and between said nozzle inlet orifices;

whereby flows of said combined primary and secondary materials are directed to said nozzle inlet orifices.

8. An apparatus as in claim 7, wherein:

each of said blades having a blade width; and said blade widths increasing in the radial direction from said first director end to said second director end.

9. An apparatus as in claim 6, wherein said director means comprising:

a conical section having a first conical end and a second conical end;

said conical section attached to said mixing disk upstream side at said second conical end;

said first conical end terminating in an arcuate cone;

said conical section having a cross-sectional are which increases from said first conical end to said second conical end;

said second conical end having an outer edge; and said outer edge intermediate said mixing disk axis and said inlet orifices.

10. A method of mixing primary materials with secondary materials, each of said primary and said secondary materials being flowable, comprising functionally applying the apparatus as claimed in claim 1.

11. A mixing disk for mixing primary materials with secondary materials, each of said primary and said secondary materials being flowable, comprising:

at least one nozzle allowing flow through said mixing disk;

said at least one nozzle having a cavity extending therethrough;

said cavity defining a nozzle inlet orifice and a nozzle outlet orifice;

said nozzle inlet orifice having an inlet cross-sectional area;

said nozzle outlet orifice having an outlet cross-sectional area;

said inlet cross-sectional area having a generally circular shape;

said outlet cross-sectional area having a non-circular shape; and said inlet cross-sectional area being greater than said outlet cross-sectional area.

12. A mixing disk as in claim 11, wherein said cavity being at least partially tapered from said nozzle inlet orifice to said nozzle outlet orifice.

13. A mixing disk as in claim 12, wherein:

said outlet cross-sectional area non-circular shape comprising two elongated slots; and each of said two elongated slots being perpendicular to and bisecting the other said elongated slot.

14. A mixing disk as in claim 13, wherein:

said mixing disk having a mixing disk axis in the direction of the flow of said primary and secondary materials;

said at least one nozzle having a nozzle axis; and said nozzle axis being parallel to said mixing disk axis.

15. A mixing disk as in claim 14, wherein:

said at least one nozzle comprises a plurality of nozzles;

each of said nozzles is identical in construction; and said nozzles are dispersed about said mixing disk axis in a symmetrical pattern.

16. A mixing disk as in claim 15, further comprising:

a director means attached to said mixing disk; and said director means directing said flow of said combined primary and secondary materials toward said nozzle inlet orifices.

17. A mixing disk as in claim 16, wherein said director means comprising:

a director body having a first director end and a second director end;

said director body attached to said mixing disk at said second director end;

said first director end terminating in an arcuate cone;

said director body having a cross-sectional diameter increasing from said first director end to said second director end; and said director body including a plurality of blades extending in the radial direction and between said nozzle inlet orifices;

whereby flows of said combined primary and secondary materials are directed to said nozzle inlet orifices.

18. A mixing disk as in claim 17, wherein:

each of said blades having a blade width; and said blade widths increasing in the radial direction from said first director end to said second director end.

19. A mixing disk as in claim 16, wherein said director means comprising:

a conical section having a first conical end and a second conical end;

said conical section attached to said mixing disk at said second conical end;

said first conical end terminating in an arcuate cone;

said conical section having a cross-sectional are which increases from said first conical end to said second conical end;

said second conical end having an outer edge; and said outer edge intermediate said mixing disk axis and said inlet orifices.

* * * * *